United States Patent [19]

Larsson

[11] Patent Number: 4,683,699

[45] Date of Patent: Aug. 4, 1987

[54] SUSPENDED CEILING STRUCTURE FOR RECTANGULAR FILTER ELEMENTS

[75] Inventor: Bertil Larsson, Tyresö , Sweden

[73] Assignee: Fläkt Aktiebolag, Nacka, Sweden

[21] Appl. No.: 806,813

[22] Filed: Dec. 10, 1985

[30] Foreign Application Priority Data

Jan. 29, 1985 [SE] Sweden ..... 8500398

[51] Int. Cl.[4] ..... E04B 5/57; E04B 5/55

[52] U.S. Cl. ..... 52/775; 52/484; 52/488; 52/764

[58] Field of Search ..... 52/488, 484, 775, 764, 52/483

[56] References Cited

U.S. PATENT DOCUMENTS

| | | | |
|---|---|---|---|
| 2,958,403 | 11/1960 | Robertson | 52/775 |
| 3,327,438 | 6/1967 | Cooper | 52/484 |
| 3,486,311 | 12/1969 | Allan, Jr. | 52/484 |
| 3,685,235 | 8/1972 | Lang | 52/488 |
| 3,981,116 | 9/1976 | Reed | 52/484 |
| 4,545,793 | 10/1985 | Shuler | 52/484 |

FOREIGN PATENT DOCUMENTS

| | | | |
|---|---|---|---|
| 2404677 | 8/1975 | Fed. Rep. of Germany | 52/484 |
| 177960 | 1/1962 | Sweden | 52/484 |
| 192529 | 11/1964 | Sweden | 52/484 |

*Primary Examiner*—William F. Pate, III
*Assistant Examiner*—Michael Safavi
*Attorney, Agent, or Firm*—Oblon, Fisher, Spivak, McClelland & Maier

[57] ABSTRACT

The invention relates to a suspended ceiling structure for rectangular filter elements (12,13), comprising a framework with outer (1) and inner (2) U-shaped channels which slidingly fit together and are suspended on tie rods (9) in an upper ceiling. The channels are intended to support skirts (14,15) arranged along the edges of the filter elements, said skirts being received in a sealing fluid (16) which forms an airtight seal for the air which is under the filter elements and is intended to flow through the same. The U-shaped channels are provided with grooves (3,4) at their web portions, the grooves being turned outwards and intended to form attachments for the ceiling tie rods and for elements (24) to be suspended from the framework. The ends (5,6) of each outer channel (1) are bent inwards to retain the inner channel (2) between the shanks and to prevent its withdrawal in a direction transverse to the longitudinal direction of the channels.

1 Claim, 6 Drawing Figures

SUSPENDED CEILING STRUCTURE FOR RECTANGULAR FILTER ELEMENTS

BACKGROUND OF THE INVENTION

1. Field of the Invention:

The present invention relates to a suspended ceiling structure for rectangular filter elements comprising a framework with outer and inner U-shaped channels which slidingly fit together and are suspended on supporting tie rods in the upper ceiling, the channels being filled with a sealing fluid and being adapted to receive skirts which are arranged along the edges of the filter elements in order to support these elements and to form an airtight seal for the air which is below the filter elements and is intended to flow through them.

2. Discussion of the Background:

Suspended ceiling structures of the kind described above are previously known, e.g. through EP-A1 116 772. This known structure, however, is marred by several drawbacks. Thus, the joints which form connecting points in the latticework and consist of X-joints, tees or angles are provided with fastening means for the tie rods. This means that when the framework is to be erected the position of the tie rods in the upper ceiling has to be accurately marked since there is no possibility to move the positions of the fastening means in case a tie rod is erroneously positioned. Consequently, at the erection of such a known suspended ceiling structure the joints which form the intersection points in the framework have to be mounted whereupon the connecting channel portions which are supported by the intersection joints can be introduced into the joint channels and fixed thereto by means of pop rivets. Such an installation is time-consuming and has to be preceded by accurate measurements to put the tie rods at correct locations in the ceiling. Neither is it aesthetically attractive to see the joint ends between the joint channels and the channels which interconnect the intersection points.

A further drawback is that holes are to be drilled in the channels by hand for lighting armature brackets or similar attachment means when lighting armature or other fittings are to be suspended in the framework.

SUMMARY OF THE INVENTION

An object of the present invention is to eliminate the abovementioned drawbacks and to provide a suspended ceiling structure that can be erected successively and where the intersection joints as well as the interconnecting channel sections can be fixed to the upper ceiling at suitable locations without preceding accurate measurement of the tie rod location.

This object is realized according to the invention substantially by the fact that the U-formed channels at their web portions are provided with grooves which are turned outwardly and are adapted to serve as attachments for tie rods and for elements which are to be suspended from the framework, and that the shank ends of each outer channel are bent inwardly in order to retain the inner channel between the shanks and to prevent withdrawal of the same in a direction transversely to the longitudinal direction of the channels.

According to the invention either the groove of the inner channel can be turned upwardly against the upper ceiling and serve as attachment for the tie rods, or the channel can be reversed so that the outer groove of the channel is turned upwards against the upper ceiling. In the latter case the outer shank ends are formed as brackets for pins which support the skirts from the filter elements which together with the shank ends of the outer and inner channels are immersed in the sealing fluid which fills the channels.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
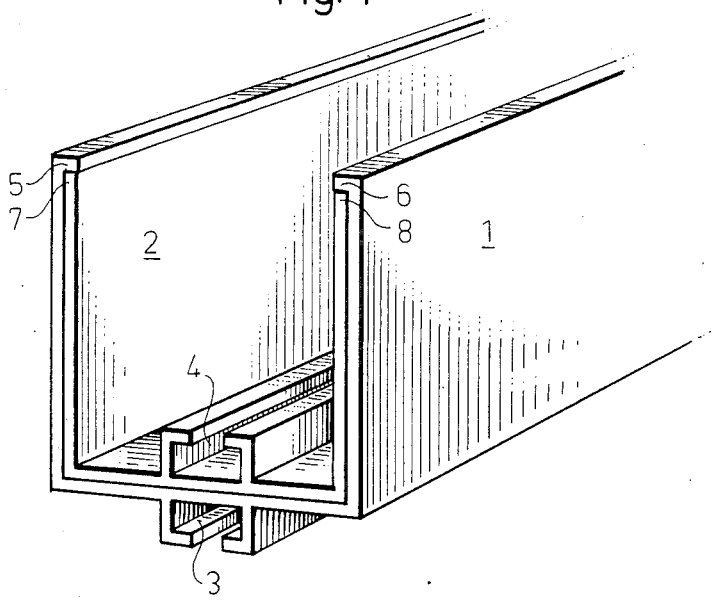
FIG. 1 is a perspective end view of U-shaped outer and inner channels according to the invention.

As appears from FIG. 1 a framework according to the invention is comprised by an outer U-shaped channel 1 and an inner U-shaped channel 2 fitting in the outer one. The outer channel 1 has a web portion which is provided with a T-shaped groove 3 whereas the web of the inner channel 2 is in a corresponding way provided with a similar groove 4. The two grooves are turned upwards and are intended to form brackets for tie rods and such elements as may be suspended from the framework. The shank ends 5, 6 of the outer channel 1 are bent inwardly over the shank ends 7 and 8 of the inner channel in order to retain the inner channel between the shanks of the outer channel and thereby prevent the latter from being removed in any other direction than in the longitudinal direction of the channels.

Figure 2:
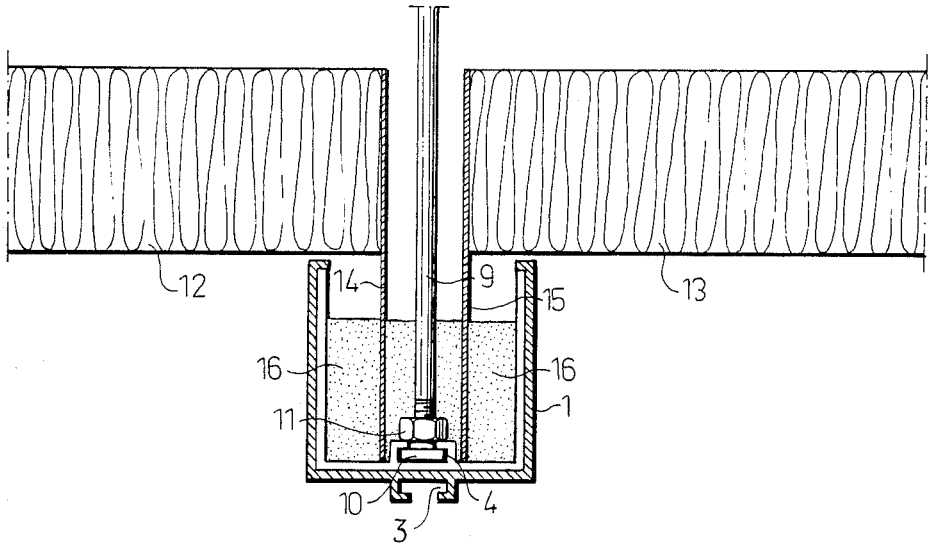
FIG. 2 is a cross-sectional view through a suspended ceiling structure according to the invention which supports rectangular filter elements.

The function of the two coordinated outer and inner channels 1 and 2, respectively, is shown on FIG. 2. The groove 4 of the inner channel is consequently turned upwards against the upper ceiling and serves as an attachment for a tie rod 9 which in its lower portion is provided with a head 10, the shape of which corresponds to the T-shaped groove 4. The tie rod is fixed in the groove by means of a nut 11 which clamps the edges of the groove against the head 10. The two filter elements 12 and 13 are provided with skirts 14 and 15 at the edges and the skirts are received in the web portion of the inner channel 2 and will thereby support the filter elements. In order to prevent unfiltered air from passing through the framework and past the filters the inner channel is filled with a sealing liquid 16 which effectively prevents air from passing past the skirts 14 and 15.

Figure 3:
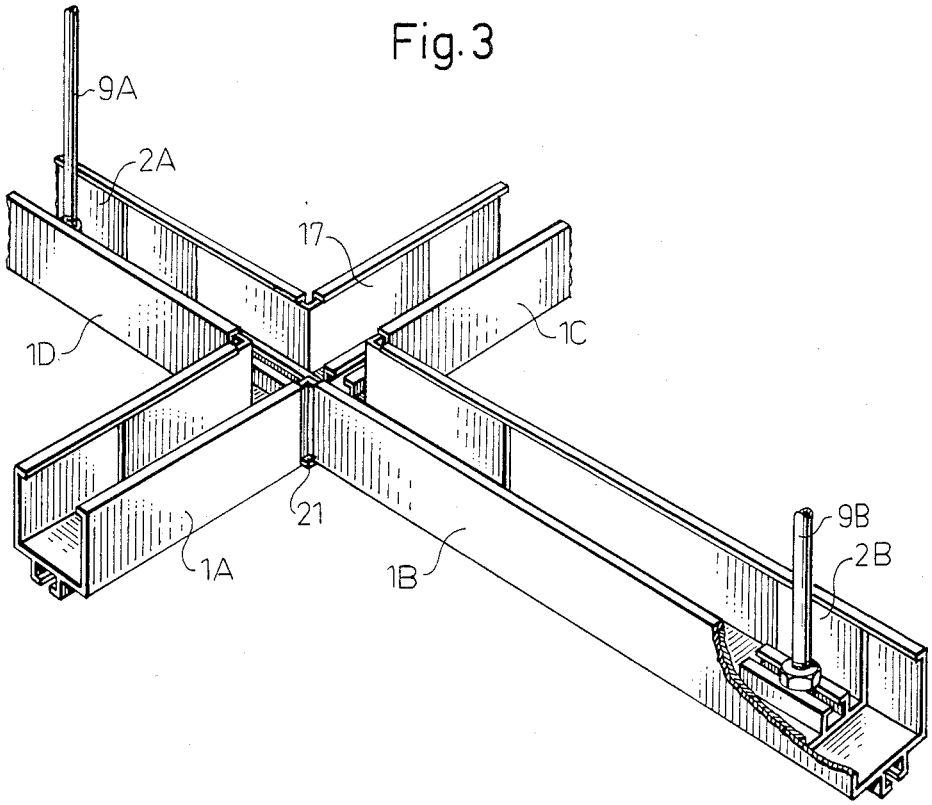
FIG. 3 is an intersection point in a framework according to the invention which is supported by tie rods.
Figure 4:
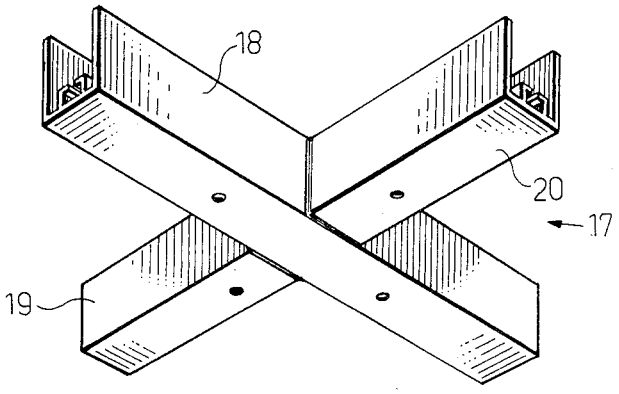
FIG. 4 shows the design of an intersection point with U-formed inner channels.

FIG. 3 shows an intersection point in a framework according to the invention where the intersection point element is comprised by an X-shaped joint 17 which is clearly shown on FIG. 4. Thus, it consists of a portion of an inner channel 18 against which two similar inner channel portions 19 and 20 are welded. The two outer channels 1A, 1B, 1C and 1D are slid over the X-shaped joint 17 and this portion of the framework is suspended by two tie rods 9A and 9B which are connected to a corresponding portion of an inner channel 2A and 2B, respectively. In order to hide the difference of level between the outer and inner channels on the underside of the framework it is possible to attach a square plate 21 on the centre portion of the X-shaped joint. The plate has the same height as the web portion of the outer channel and can be glued or screwed onto this member.

Figure 5:
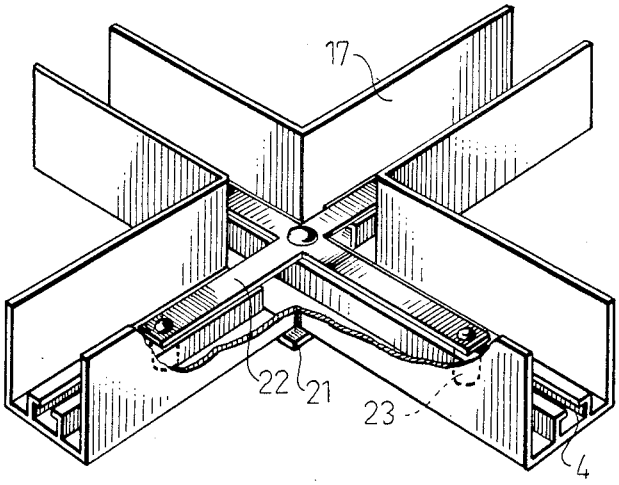
FIG. 5 shows the intersection point according to FIG. 4 which is provided with a locking device for the outer channels.

FIG. 5 shows an X-shaped joint which is provided with a locking device comprising a cross 22 of resilient material which is attached to the middle of the X-shaped joint in the middle of the T-shaped groove and which at the ends is provided with pins 23 adapted to resiliently snap into a corresponding recess on the inner side of the outer channel when this is slid over the inner channel and has reached its end position.

Figure 6:
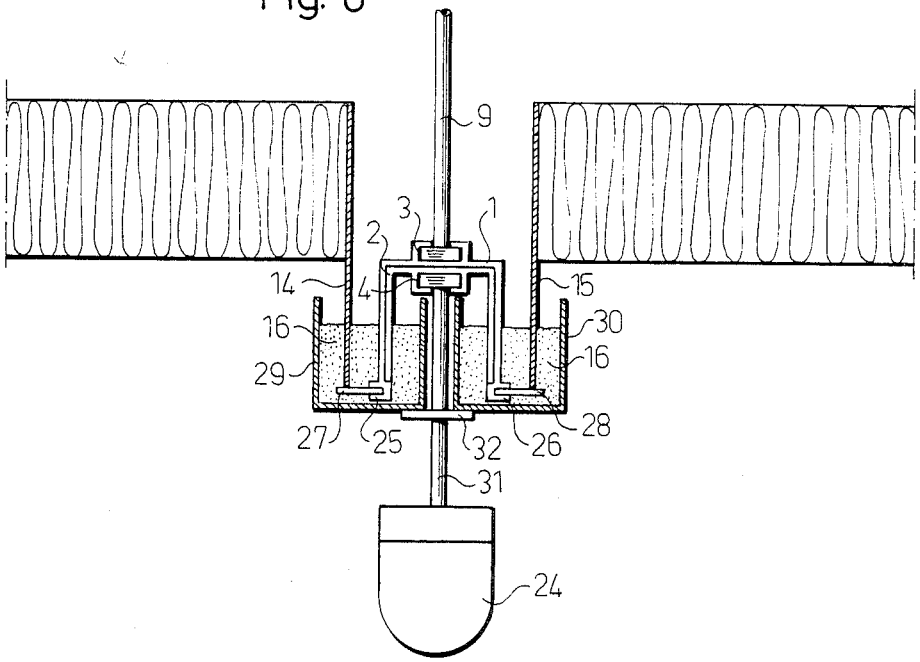
FIG. 6 is a cross-sectional view of an alternative embodiment of the suspended ceiling structure according to the invention.

FIG. 6 shows an alternative embodiment of the invention where the assembled inner and outer channels are turned upside down so that the groove 3 of the outer channel 1 is turned upwards towards the upper ceiling and serves as an attachment for the tie rod 9. The groove 4 of the inner channel 2 is turned downwards and serves as attachment for a lighting fitting 24. In this embodiment the ends of the outer channel 8 are provided with brackets 25 and 26 for studs 27 and 28 which are assembled to support the skirts 14 and 15 of the filter elements. The ends of the channels 1 and 2 as well as the skirts 14 and 15 are received in corresponding channels 29 and 30, respectively, which are filled with a sealing liquid 16. The channels are substantially U-shaped and are supported by plates 32 arranged on the tie rod 31. This arrangement has the advantage compared to the arrangement according to FIG. 2 that the sealing channel can be filled with a sealing liquid before delivery and can then be protected by means of a protective tape which is easy to remove just before the installation. In the embodiment according to FIG. 2 the sealing liquid has to be filled after the framework has been erected and this in its turn demands a fairly complicated equipment for heating and filling the liquid which is difficult to handle and which rapidly solidifies when it has flowed out in the channels. Moreover, all joints in the system must be tight in order not to cause leakage which can be difficult to tighten if it is discovered when the filling in of sealing liquid just has commenced. The sealing liquid can either consist of a gel solution which is liquid at higher temperatures but solidifies at room temperature or a curing or non-curing silicone mass.

Obviously, numerous modifications and variations of the present invention are possible in light of the above teachings. It is therefore to be understood that within the scope of the appended claims, the invention may be practiced otherwise than as specifically described herein.

I claim:

1. A suspended ceiling structure for rectangular filter elements having skirts depending from the edges of the filter elements, said structure comprising a framework suspended by tie rods and comprising outer and inner U-shaped channels, an internal surface of the outer channel slidingly receiving an external surface of the inner channel, each of said channels comprising a web portion and shank portions extending therefrom, the web portion of each channel being provided with a longitudinal groove disposed such that the grooves of the inner and outer channels, respectively, face away from each other when the channels are fitted together, the groove of the outer channel facing upwardly and comprising attachment means attaching the framework to the tie rods, and the groove of the inner channel facing downwardly, wherein ends of said shank portions of said outer channel comprise inwardly extending members retainingly engaging the inner channel, and wherein said ends of the shank portions of the outer channel are provided with pin receiving means for receiving pins supporting the skirts of the filter elements; and said structure further comprising substantially U-shaped parallel sealing channels filled with a sealing liquid and receiving ends of the shank portions of the inner and outer channels, receiving the skirts and being disposed at a substantially common level, to form an airtight seal against the passage of air that is intended to flow through the filter elements.

* * * * *